US011648450B1

(12) United States Patent
Sun

(10) Patent No.: US 11,648,450 B1
(45) Date of Patent: May 16, 2023

(54) TABLE-TENNIS TRAINING APPARATUS AND METHOD THEREOF

(71) Applicant: Zeqi Sun, Calgary (CA)

(72) Inventor: Zeqi Sun, Calgary (CA)

( * ) Notice: Subject to any disclaimer, the term of this patent is extended or adjusted under 35 U.S.C. 154(b) by 16 days.

(21) Appl. No.: 17/566,646

(22) Filed: Dec. 30, 2021

(51) Int. Cl.
*A63B 69/00* (2006.01)
*A63B 102/16* (2015.01)

(52) U.S. Cl.
CPC ..... *A63B 69/0073* (2013.01); *A63B 2102/16* (2015.10); *A63B 2225/055* (2013.01)

(58) Field of Classification Search
CPC ..... A63B 69/0073; A63B 2102/16; A63B 2225/055
USPC ..... 473/417
See application file for complete search history.

(56) References Cited

U.S. PATENT DOCUMENTS 3,477,717 A * 11/1969 Clarke ..... A63B 67/04 473/475
3,809,406 A * 5/1974 Lohr ..... A63B 69/0079 473/474
4,460,172 A * 7/1984 Hogan ..... A63B 69/0091 473/426
4,846,472 A * 7/1989 Terza ..... A63B 69/0002 473/424
5,467,979 A * 11/1995 Zarate ..... A63B 69/0091 473/429
6,306,050 B1 * 10/2001 Holder ..... A63B 69/0084 473/421
7,115,052 B2 * 10/2006 Wardle ..... A63B 69/38 473/429
2009/0191987 A1 * 7/2009 Fleming ..... A63B 67/04 473/475
2019/0282877 A1 * 9/2019 Cunnane ..... A63B 69/0091
2020/0016469 A1 * 1/2020 Robertson ..... A63B 69/38

* cited by examiner

*Primary Examiner* — Nini F Legesse

(57) ABSTRACT

A table-tennis training apparatus for training a player to apply spin to a table-tennis ball when using a racket to hit the ball. The table-tennis training apparatus has a ball holder for rotatably holding a table-tennis ball. When the ball thereon is hit by a racket, the ball holder pivots about an axis and an elastic structure coupled to the ball holder dampens the speed of the ball holder to prolong the contact time between the racket and the ball and consequently help the player to more clearly experience the feeling of applying spin to the ball and thus facilitate the player's training of applying spins to the ball.

10 Claims, 5 Drawing Sheets

TABLE-TENNIS TRAINING APPARATUS AND METHOD THEREOF

FIELD OF THE DISCLOSURE

The present disclosure relates generally to apparatus and method for training players' skills of playing table-tennis games, and in particular relates to apparatus and method for training players' skills of applying spins to table-tennis balls.

BACKGROUND

In table-tennis games, applying spin to a table-tennis ball is an important skill. A player may use a racket to hit the table-tennis ball and apply spin thereto. By controlling the hitting point of the ball and the force of hitting, the player may control the spinning pattern and spinning speed of the ball. After hitting, the spinning ball flies through the air and the frictions between the air and different portions of the surface of the ball cause various air flows flowing about the table-tennis at various speeds and directions. According to Bernoulli's equation, such differences in the airflow speeds and directions may cause pressure differences on different parts of the ball, thereby changing the trajectory thereof. Subsequently, when the spinning ball contacts the table, the bounce direction thereof may change due to the friction between the ball and the contact point of the table, which greatly increases the complexity of the ball movement and significantly reduces the chances of the player on the other side of the table to successfully return the ball.

Thus, in today's table-tennis games, applying spins to the table-tennis ball is an essential skill. However, players with many years of table-tennis experiences (not to mention the beginners) may still struggle to properly apply spins as it is generally very difficult for players to master the feeling of gripping the ball using their rackets and applying spins thereto within the short time that the ball touches the racket.

SUMMARY

According to one aspect of this disclosure, there is provided an apparatus comprising: a supporting structure; a ball holder for rotatably holding a table-tennis ball thereon, the ball holder rotatably coupled to the supporting structure; and an elastic structure coupled to the ball holder for, after the ball held on the ball holder is hit by a racket, dampening the speed of the ball holder and resetting the ball holder to an initial position.

In some embodiments, the ball holder comprises a Y-shaped wire structure having a leg and a pair of arms extending from the leg.

In some embodiments, the supporting structure comprises a post.

In some embodiments, the post is a telescopic post.

In some embodiments, the supporting structure comprises a mounting structure.

In some embodiments, the mounting structure comprises a suction cup.

According to one aspect of this disclosure, there is provided table-tennis training system comprising a first and a second apparatus as described above which are arranged side-by-side on a surface; and the second apparatus is configured such that the table-tennis ball thereon is at an elevation lower than that of the table-tennis ball on the first apparatus.

DETAILED DESCRIPTION

Embodiments disclosed herein relate to a table-tennis training apparatus for training a player to apply spin to a table-tennis ball when using a racket to hit the ball. According to one aspect of this disclosure, the table-tennis training apparatus comprises a ball holder for rotatably holding a table-tennis ball. The ball holder is pivotable about an axis when the ball thereon is hit by a racket, wherein an elastic structure coupled to the ball holder dampens the speed of the ball holder to prolong the contact time between the racket and the ball and consequently help the player to more clearly experience the feeling of applying spin to the ball and thus facilitate the player's training of applying spins to the ball.

Figure 1:
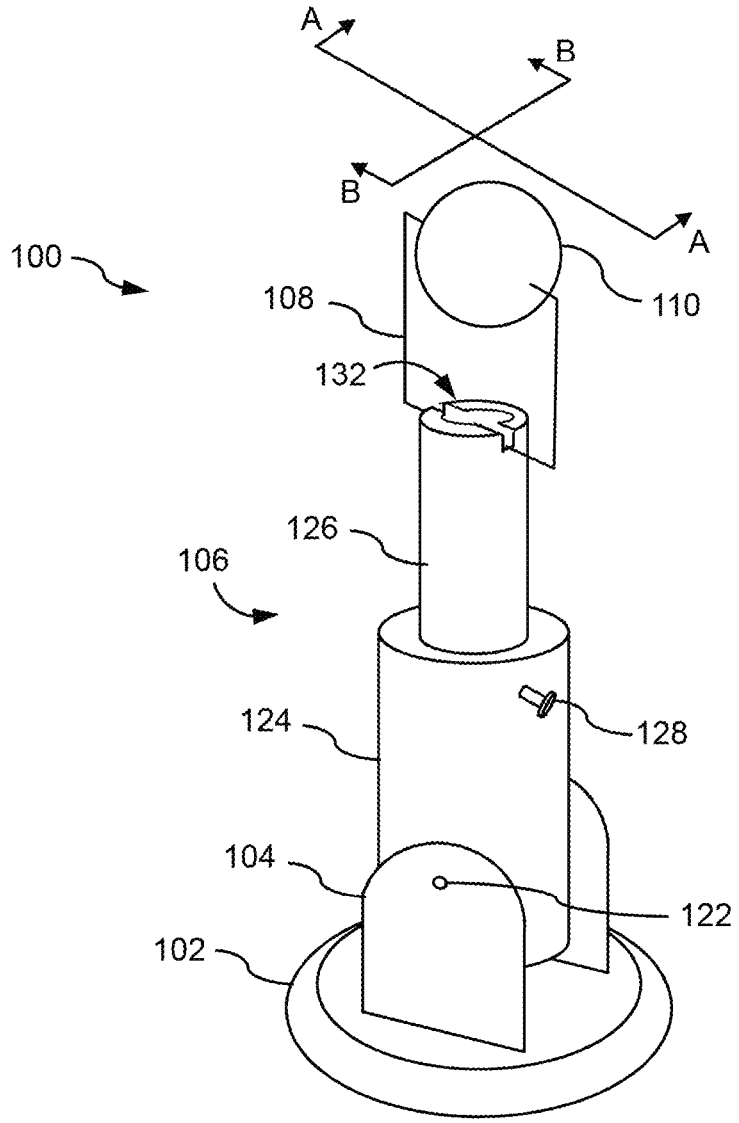
FIG. 1 is a perspective view of a table-tennis training apparatus rotatably supporting a table-tennis ball, according to some embodiments of this disclosure.
Figures 2A, 2B:
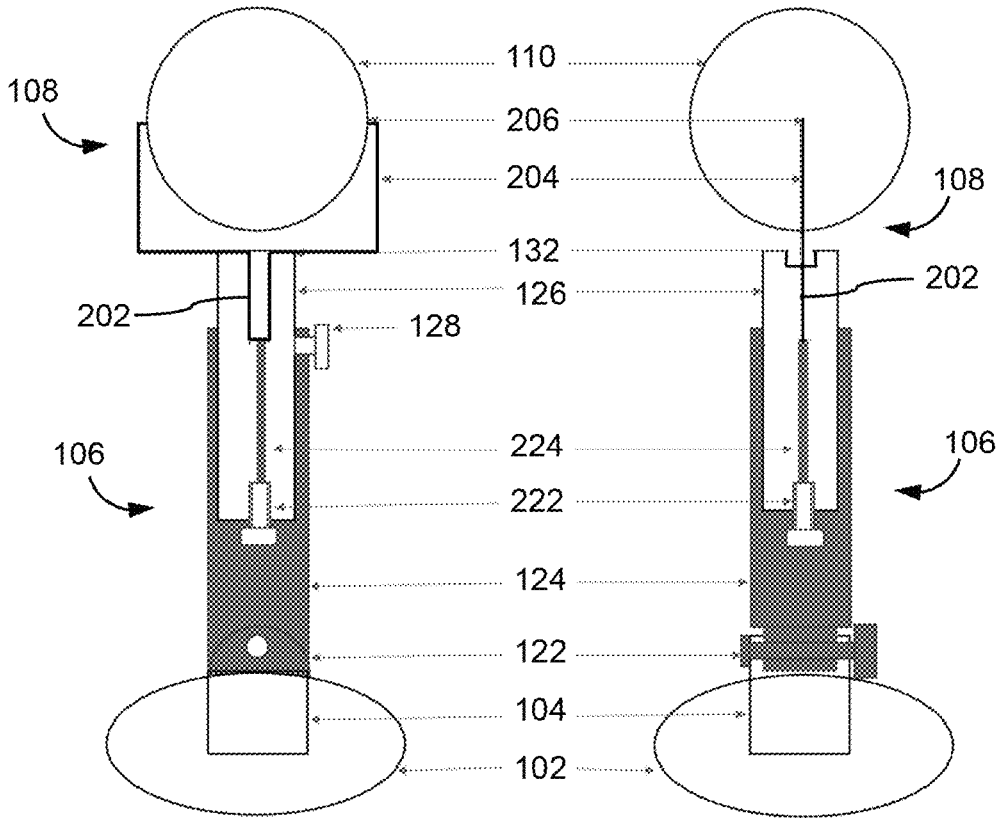
FIG. 2A is a cross-section view of the table-tennis training apparatus shown in FIG. 1 along the cross-section line A-A.
FIG. 2B is a cross-section view of the table-tennis training apparatus shown in FIG. 1 along the cross-section line B-B.

Turning now to FIGS. 1, 2A and 2B, a table-tennis training apparatus according to some embodiments of this disclosure is shown and is generally identified using reference numeral 100. As shown, the table-tennis training apparatus 100 comprises a mounting structure 102, a pivoting structure 104 coupled to the mounting structure 102, a telescopic post 106 pivotably coupled to the support structure 104, and a ball holder 108 coupled to the telescopic post 106 at a first end thereof and holding and supporting a table-tennis ball 110 at a second, opposite end thereof.

In these embodiments, the mounting structure 102 is in the form of a rubber suction cup for mounting to a surface such as the surface of a table-tennis table, the surface of a desk, or the like. Those skilled in the art will appreciate that the mounting structure 102 in other embodiments may be in other suitable forms such as a weight base for steadily seating on a surface, a clamp for claiming to a surface, and/or the like.

The pivoting structure 104 comprises a pivot 122 for coupling to the telescopic post 106 to allow the telescopic post 106 to rotate about the pivot 122 and position at a desired angle. The telescopic post 106 may have a tight fit to the pivot 122 such that once a player adjusts the angle of the telescopic post 106, the telescopic post 106 may steadily maintain its position during the table-tennis training. Alternatively, the pivoting structure 104 may comprise a fastening component (not shown) to fasten the telescopic post 106 at the desired angle.

The telescopic post 106 in these embodiments comprises a first post section 124 in the form of a hollow cylinder telescopically receiving therein a second post section 126 also in the form of a hollow cylinder. The second post section 126 comprises a slot 132 on the distal end thereof.

In these embodiments, the second post section 126 may be pulled or pushed by a player to extend out of or retract into the first post section 124, respectively. A set screw 128 may be extended through a hole (not shown) on the sidewall of the first post section 124 and engage the second post section 126 to position the second post section 126 at a desired extension with respect to the first post section 124.

Figures 3A, 3B:
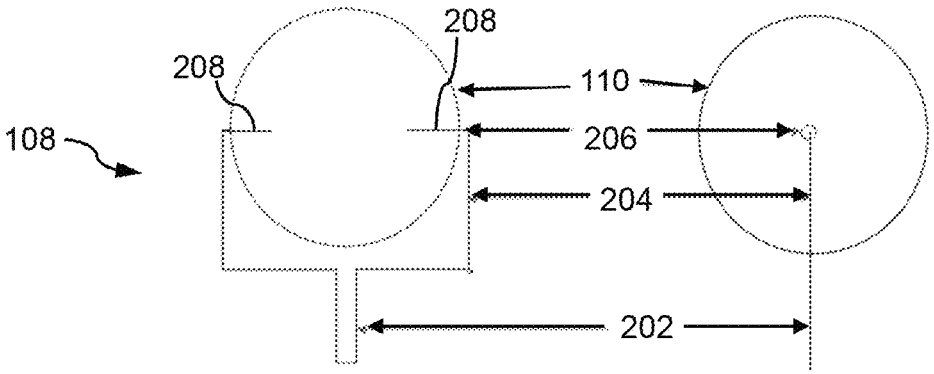
FIG. 3A is a schematic front view of a ball holder of the table-tennis training apparatus shown in FIG. 1.
FIG. 3B is a side view of the ball holder shown in FIG. 3A.

As shown in FIG. 3, the ball holder 108 in these embodiments is in the form of Y-shaped wire structure having a leg 202 and a pair of arms 204 extending from the leg 202. The distal portions 208 of the arms 204 extend into the table-tennis ball 110 through a pair of holes 206 punctuated on opposite sides of the table-tennis ball 110 to rotatably support the table-tennis ball 110 and define a rotation axis therefor.

Referring back to FIGS. 1 to 2B, the leg 202 of the ball holder 108 extends into the telescopic post 106 with the arms 204 positioned in the slot 132 of the second post section 126. The arms 204 thereof thus engage the bottom of the slot 132 thereby defining a rotation axis along the slot 132 for the ball holder 108 and the table-tennis ball 110 thereon to allow them to rotate at directions perpendicular thereto.

In the telescopic post 106, the leg 202 of the ball holder 108 is elastically coupled to an adjustable mounting point 222 such as an adjustable screw positioned in the telescopic post 106, via an elastic structure 224 such as an elastic rubber band, a spring, and/or the like.

The table-tennis training apparatus 100 may be used for training a player to apply spin to a table-tennis ball when using a racket to hit the ball.

Figure 4:
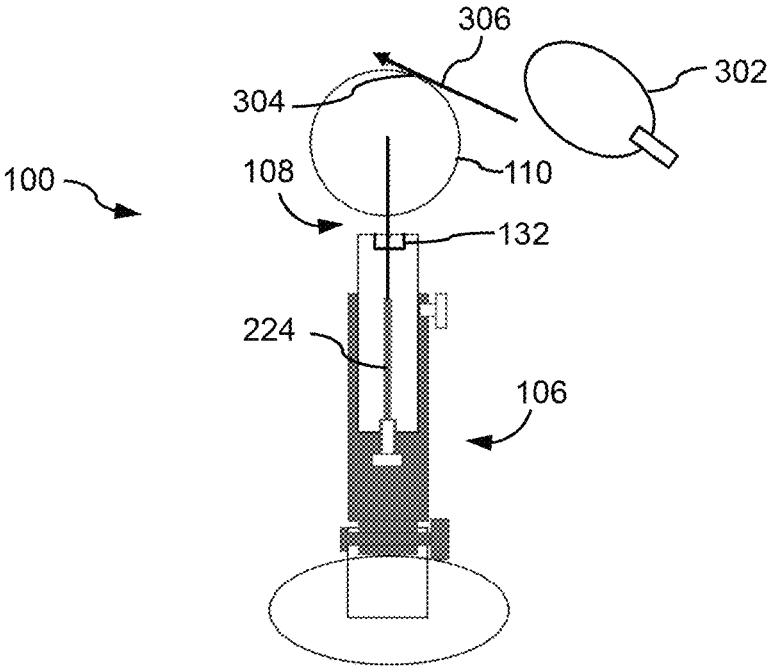
FIG. 4 is a side view of the table-tennis training apparatus shown in FIG. 1 in a stationary position when a racket is to hit an upper position of the table-tennis ball.

For example, a player may position the table-tennis training apparatus 100 on a surface and adjust the telescopic post 106 such that the player may comfortably hit the table-tennis ball 110. As shown in FIG. 4, the elastic structure 224 holds the ball holder 108 and the table-tennis ball 110 thereon at an initial, equilibrium position.

The player may start the training by using a racket 302 to hit the ball 110 at a desired position 304 thereof along a direction 306. In this example, the hitting direction 306 is preferably tangential to the ball 110 so as to apply spin to the ball 110 when hitting it.

Figure 5:
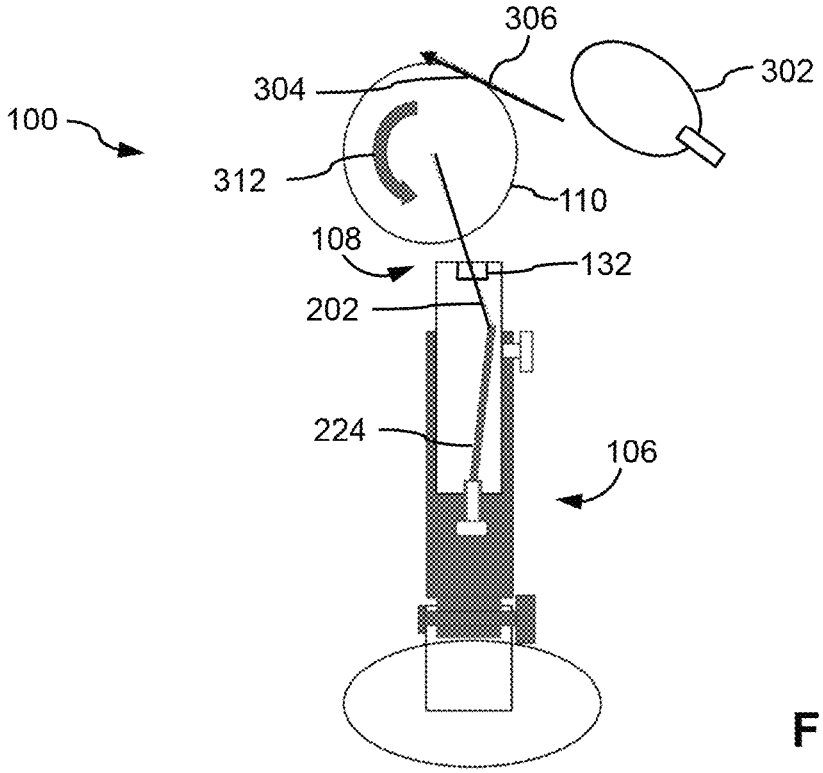
FIG. 5 is a side view of the table-tennis training apparatus shown in FIG. 1 after a racket hits the table-tennis ball on the table-tennis training apparatus.

As shown in FIG. 5, when the racket 302 hits the ball 110 tangentially at the position 304, the ball 110 is forced to spin about the axis or the distal portions 208 of the ball holder 108 as indicated by the arrow 312 and move forward, thereby causing the arms 204 of ball holder 108 to freely swing forward with respect to the slot 132. Consequently, the leg 202 of the ball holder 108 swings rearward and biases the elastic structure 224.

The biased elastic structure 224 applies a rearward force to the ball 110 and dampens or slows down the speed thereof that the ball 110 may otherwise gain, thereby prolonging the contact time between the racket 302 and the ball 110. The prolonged contact time between the racket 302 and the ball 110 may help the player to more clearly experience the feeling of applying spin to the ball 110 and thus facilitate the player's training of applying spins to the ball.

With the reducing of the momentum of the ball holder 108, the tension of the biased elastic structure 224 automatically resets the ball holder 108 and the table-tennis ball 110 thereon back to the equilibrium position.

Figure 6:
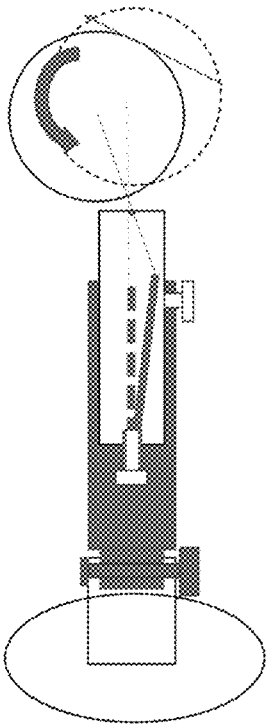
FIG. 6 a schematic side view showing a comparison of the table-tennis training apparatus shown in FIG. 1 before and after a racket hits the table-tennis ball on the table-tennis training apparatus.

FIG. 6 a schematic side view showing a comparison of the table-tennis training apparatus 100 before and after a racket hits the table-tennis ball on the table-tennis training apparatus. The dotted line shows the positions of the ball holder 108 and the ball 110 before the ball 110 is hit, and the solid lines shows the positions of the ball holder 108 and the ball 110 after the ball 110 is hit.

As those skilled in the art will appreciate, the player may continue to practice without pause. Such a continued training provides the player an experience that is resemble a table-tennis rallying while at the same time increasing the training efficiency.

Figure 7:
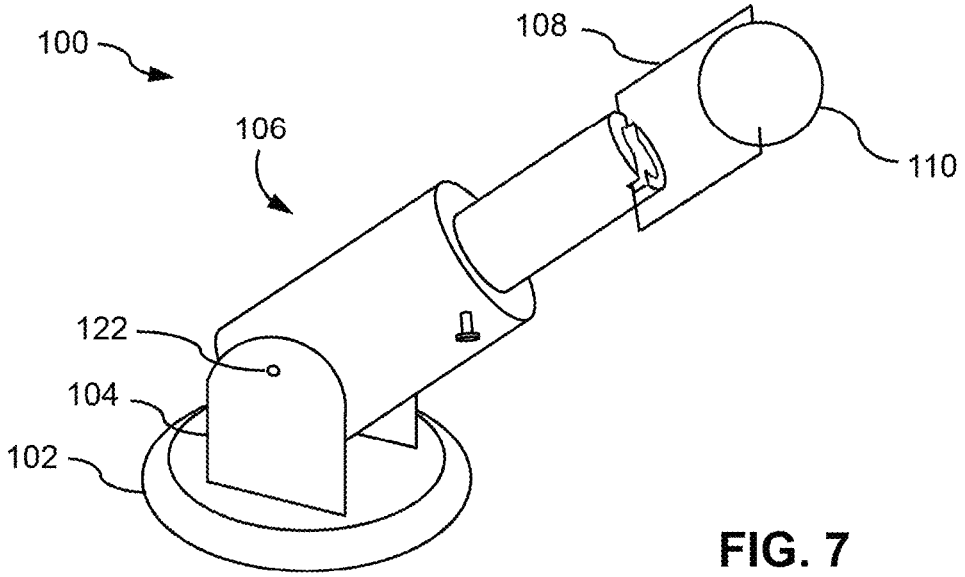
FIG. 7 is a side view of the table-tennis training apparatus shown in FIG. 1 wherein a post of the table-tennis training apparatus, the ball holder thereof, and the ball thereon are adjusted from an upright configuration to an angled configuration.

As shown in FIG. 7, the player may pivot the telescopic post 106 about the pivot 122 to adjust the telescopic post 106, the ball holder 108, and the ball 110 from an upright configuration to an angled configuration. For example, the player may position the table-tennis training apparatus 100 about an edge of a surface and pivot the telescopic post 106 to a horizontal position for training how to apply spins to the ball 100 when hitting the ball upwardly.

Figure 8:
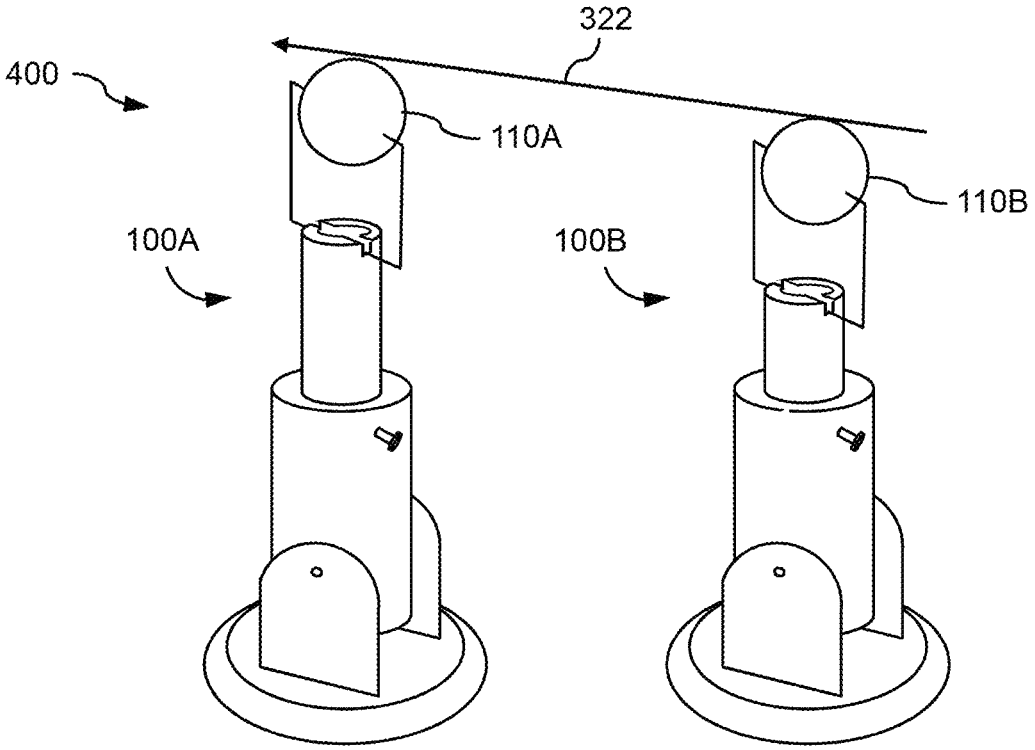
FIG. 8 is a perspective view of a table-tennis training system having two table-tennis training apparatuses shown in FIG. 1 positioned side-by-side on a surface, according to some embodiments of this disclosure.

FIG. 8 shows a table-tennis training system 400 according to some embodiments of this disclosure. The table-tennis training system 400 comprises two table-tennis training apparatuses 100A and 100B positioned side-by-side on a surface (not shown) wherein the ball 110B of the table-tennis training apparatus 100B positioned at a lower height or elevation than that of the ball 110A of the table-tennis training apparatus 100A. A player may use the bracket (not shown) to first hit the ball 110B and then hit the ball 110A. The elevation difference of the balls 110A and 1108 limits the player to only be able to hitting both ball 110A and 110B by swinging the racket at a particular angle and along a particular trajectory as indicated by the arrow 322. Thus, such an arrangement of two table-tennis training apparatuses 100A and 100B allows the player to practice how to apply spin to the ball 110B while at the same time adjusting the direction of the racket to be in the right position.

In some embodiments, the ball holder 108 of table-tennis training apparatus 100 may not comprise a leg 202. In these embodiments, the elastic structure 224 of the table-tennis training apparatus 100 may comprise one or more spiral elastic components such as one or more spiral springs and/or one or more elastic rubber bands coupled to or wound about one or both arms 204 of the ball holder 108 for dampening the speed of the ball 110 when the ball 110 is hit and causing bias to the one or more spiral elastic components 224.

In some embodiments, the arms 204 of the ball holder 108 may not extend into the ball 110 (and therefore the ball 110 does not need to be punctuated). Rather, each arm 204 may comprise an interface for rotatably engaging the ball 110 with a suitable pressure. Each interface comprises a contour matching the contact surface of the ball 110 to prevent the ball 100 from falling off the ball holder 108.

In some embodiments, the mount point 222 may not be adjustable.

Those skilled in the art will appreciate that, in various embodiments, the telescopic post 106 may be any suitable telescopic post that may be telescope using any suitable methods.

In some embodiments, the table-tennis training apparatus 100 may not comprise a telescopic post 106. Rather, the table-tennis training apparatus 100 in these embodiments may comprise a post with an unadjustable length.

In some embodiments, the post 106 may not comprise a slot 132 at the distal end thereof. Rather, the post 106 may comprise a hinge for rotatably coupling to the arms 204 of the ball holder 108 to allow the ball holder 108 to rotate about an axis defined by the hinge.

In some embodiments, the table-tennis training apparatus 100 may not comprise a pivoting structure 104. Rather, the post 106 of the table-tennis training apparatus 100 in these embodiments may be directly coupled to the mounting structure 102.

Although embodiments have been described above with reference to the accompanying drawings, those of skill in the art will appreciate that variations and modifications may be made without departing from the scope thereof as defined by the appended claims.

What is claimed is:

1. An apparatus comprising:

a supporting structure comprising a hollow section;

a ball holder partially extending into the hollow section of the supporting structure from a first end thereof and pivotable with respect to the supporting structure about a first axis;

a table-tennis ball coupled to the ball holder and rotatable about a second axis parallel to the first axis: and an elastic structure extending in the hollow section of the supporting structure and coupling the ball holder to the supporting structure for, after the ball held on the ball holder is hit by a racket, dampening the speed of the hall holder and resetting the ball holder to an initial position.

2. The apparatus of claim 1, wherein the ball holder comprises a Y-shaped wire structure having a leg and a pair of arms extending from the leg.

3. The apparatus of claim 1, wherein the supporting structure comprises a post.

4. The apparatus of claim 3, wherein the post is a telescopic post.

5. The apparatus of claim 1, wherein the supporting structure comprises a mounting structure.

6. The apparatus of claim 5, wherein the mounting structure comprises a suction cup.

7. A table tennis training system comprising a first and a second apparatus of claim 1 arranged side-by-side on a surface;

wherein the second apparatus is configured such that the table-tennis ball thereon is at an elevation lower than that of the table-tennis ball on the first apparatus.

8. The apparatus of claim 1, wherein the supporting structure comprises a slot on the first end of the hollow section pivotably engaging the ball holder and defining the first axis.

9. The apparatus of claim 1, wherein the elastic structure is coupled to an adjustable mounting point at a second end of the hollow section of the supporting structure, the second end opposite to the first end.

10. The apparatus of claim 1, wherein the supporting structure comprises a post pivotably coupled to a mounting structure.

* * * * *